US006890162B2

(12) United States Patent
Ding

(10) Patent No.: US 6,890,162 B2
(45) Date of Patent: May 10, 2005

(54) EMULSION PUMP WITH AN AIR CHANNEL PREVENTING LIQUID ENTRANCE

(76) Inventor: Yao wu Ding, Room 104, Building 10, Lan Yuan, Yanling Village, Taixing, Jiangsu (CN), 225400

( * ) Notice: Subject to any disclaimer, the term of this patent is extended or adjusted under 35 U.S.C. 154(b) by 27 days.

(21) Appl. No.: 10/621,626

(22) Filed: Jul. 17, 2003

(65) Prior Publication Data

US 2004/0062667 A1 Apr. 1, 2004

Related U.S. Application Data

(63) Continuation of application No. PCT/CN02/00326, filed on May 13, 2002.

(30) Foreign Application Priority Data

May 16, 2001 (CN) ..... 01221317 U

(51) Int. Cl.[7] ..... F04B 53/12
(52) U.S. Cl. ..... 417/572; 222/321.7; 222/321.9
(58) Field of Search ..... 417/572, 554; 222/321.7, 321.9

(56) References Cited

U.S. PATENT DOCUMENTS 5,570,819 A * 11/1996 Uehira et al. ..... 222/190
6,036,059 A * 3/2000 VanBrocklin ..... 222/321.9
6,196,424 B1 * 3/2001 Bougamont et al. ..... 222/321.9

FOREIGN PATENT DOCUMENTS

| | | |
|---|---|---|
| CN | 1136526 | 11/1996 |
| CN | 2242132 Y | 12/1996 |
| CN | 2314128 Y | 4/1999 |
| CN | 2371155 Y | 3/2000 |

* cited by examiner

*Primary Examiner*—Charles G. Freay
(74) *Attorney, Agent, or Firm*—Dorsey & Whitney LLP

(57) ABSTRACT

An emulsion pump mainly comprises a piston rod, a pressing head, a screw-topped sleeve, a cylinder, a spring, a rubber pipe and a gasket. Among them, the upper screw thread of the cylinder engages with a screw thread portion of the screw-topped sleeve. The width of the teeth of the upper end screw thread of the cylinder is A, the width of the gullet the screw thread portion of the screw-topped sleeve which is connected with the screw thread of the cylinder is B, and B is greater than A, thereby a gap exists between them; in addition, a gap is also formed between the contact surface of the upper end of the cylinder and the lower surface of the top portion of the screw-topped sleeve, thereby an air channel for preventing liquid entrance is formed in the emulsion pump.

2 Claims, 4 Drawing Sheets

EMULSION PUMP WITH AN AIR CHANNEL PREVENTING LIQUID ENTRANCE

CROSS-REFERENCE TO RELATED APPLICATIONS

This application is a continuation of International Patent Application PCT/CN02/00326, filed on May 13, 2002, which claims priority to Chinese Patent Application 01221317.9, filed on May 16, 2001, the contents of both are incorporated herein by reference.

FIELD OF THE INVENTION

The present invention relates to an emulsion pump with an air channel preventing liquid entrance.

BACKGROUND OF THE INVENTION

During operation, the emulsion pump constantly draws out the emulsion from a bottle, and simultaneously air is supplemented to the bottle to balance the pressure between inside and outside of the bottle so that the continuous drawing out of emulsion from the bottle can be assured. Such channel for the flow of air is referred to as "air channel". In prior art emulsion pump as shown in FIG. 1, one or more holes are provided on the wall of the cylinder 1 (only one hole is shown in FIG. 1) to communicate the pressure between the inside and the outside of the bottle. However, the hole 2, while contributing to the balance of the pressure between the inside and the outside of the bottle, brings unfavourable or negative effect on the pump. For example, during the transportation, the emulsion in the bottle can easily enter into the cylinder 1 via the hole 2. At this time, the pressing head 3 of the emulsion pump is usually locked as shown in FIG. 1. Consequently, the emulsion which enters into the cylinder 1 will adhere on the piston rod 4. When the emulsion pump is activated, the piston rod 4 will go up past the cylinder lid 5 following the pressing head 3, thereby the emulsion which is now on the piston rod 4 will be exposed, and the so called phenomenon of "liquid creeping-up" occurs.

The phenomenon of the liquid creeping-up is not only unaesthetic, but also gives undesirable effect in use, therefore it must be overcome.

The purpose of the present invention is to provide an emulsion pump with an air channel preventing liquid entrance, which enable not only the pressure between the inside and the outside of the bottle to be balanced, but also can prevent emulsion from contacting the piston rod, thereby preventing the occurrence of the phenomenon of liquid creeping-up.

SUMMARY OF THE INVENTION

The purpose of the present invention is achieved by the following technical solution.

The emulsion pump provided by the present invention comprises a piston rod in which an upper one-way valve is disposed; a pressing head, fixed on the upper end of the piston rod; a screw-topped sleeve, on the lower portion wall of its central through hole is integrated a guide sleeve for preventing liquid from entering, the inner wall of said liquid entrance preventing guide sleeve is slidably matched with the outer wall of the piston rod; a cylinder, the upper screw thread of which engages with the screw thread portion of the screw-topped sleeve, in the cylinder, a lower one-way valve and a spring are provided; a rubber pipe, its upper end is fixedly connected with the lower end of the cylinder; and a gasket, which is disposed on the outer side of the upper end of the cylinder and tightly abuts on the lower surface of the inner side of the screw-topped sleeve; among them, the width of the screw-topped of the upper end screw-thread of the cylinder is A, the gullet width of the screw-thread portion of the screw-topped sleeve which engages with the screw-thread of the cylinder is B, and B is greater than A. In addition, there is a gap between the contact surfaces of the upper end of the cylinder and the lower surface of the top portion of the screw-topped sleeve.

In the said emulsion pump, there is at least a notch on the upper end of the cylinder.

The advantage of the present invention is that the air channel formed as above can effectively prevent the emulsion from flowing out in reverse direction along the air vent. The reasons are because:

1. The gasket plays an important role of a barrier, the air can easily pass through the gap between the cylinder and the gasket but the emulsion cannot.
2. When the upper screw-thread of the cylinder engages with the screw-threads on the screw-topped sleeve, a gap is formed between their screw-threads, this gap extends along the helical line around the cylinder, it is difficult for the emulsion to enter;
3. The air channel thus formed will go up to and pass through the notch which is the highest point of the top end of the cylinder, it is difficult for the emulsion to creep up to such a height;
4. Due to the fact that before the emulsion can enter into the bottle, it must pass through a tortuous route of the air channel which includes the gap between guide sleeve for preventing liquid entrance of screw-topped and the piston rod, the notch on the upper end of the cylinder, the gap between the cylinder and the screw-thread of the screw-topped sleeve, the gap between the gasket and the outer side wall of the cylinder, therefore it is impossible for the emulsion to pass through such a long, high and winding air channel.

DESCRIPTION OF THE DRAWINGS

The concrete structure of the present invention will be given by the following embodiment and the accompanying drawings.

Among the drawings.

DETAILED DESCRIPTION OF THE INVENTION

Figure 1:
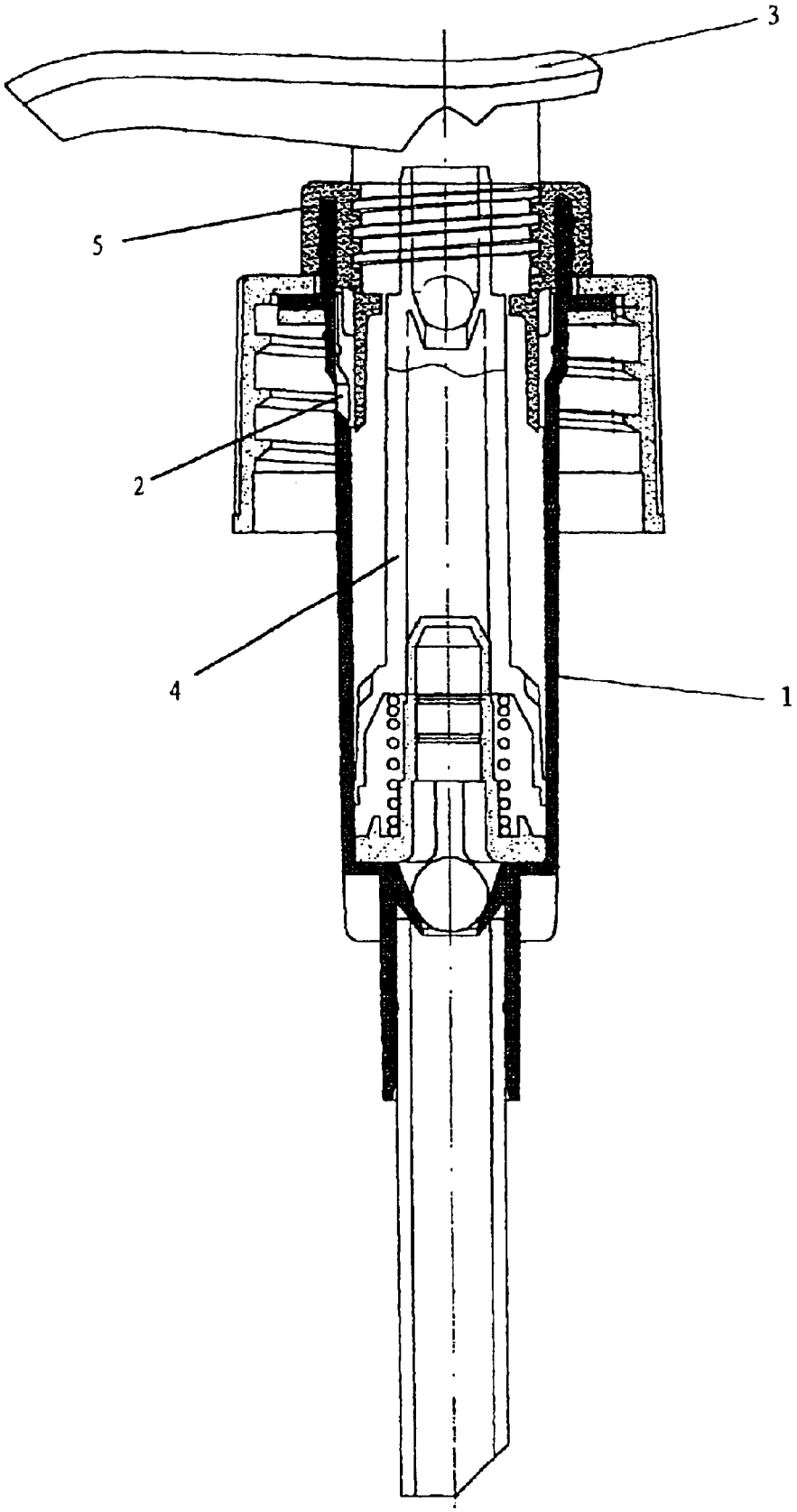
FIG. 1 is a schematic view of the prior art emulsion pump.
Figure 2:
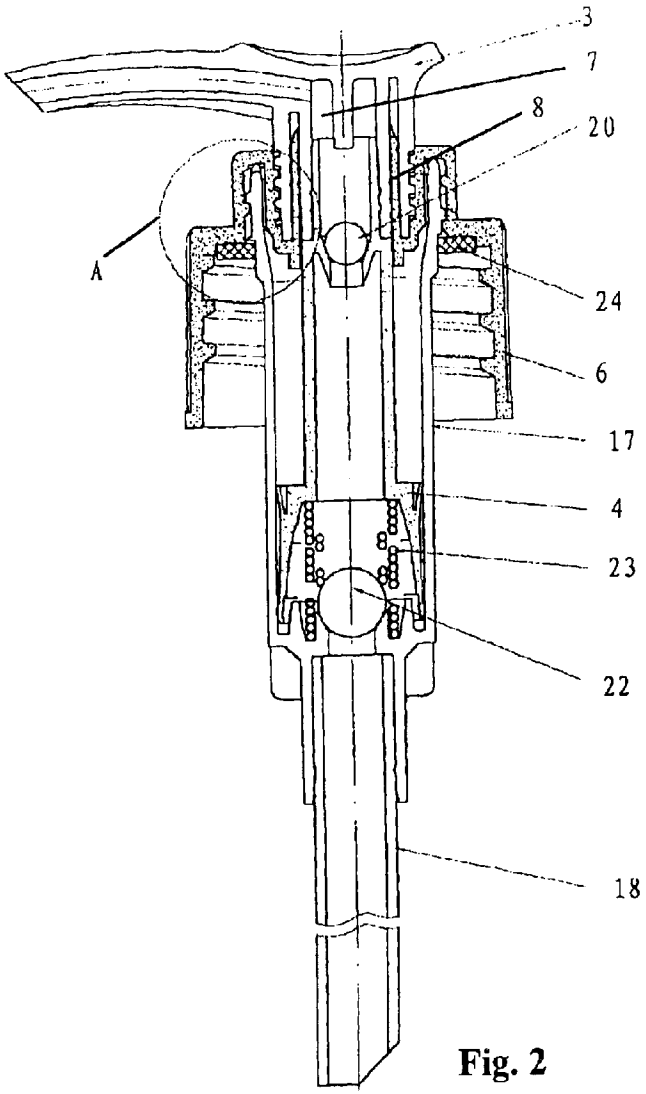
FIG. 2 is a schematic view of the structure of the emulsion pump according to the present invention in the locked state.
Figure 4:
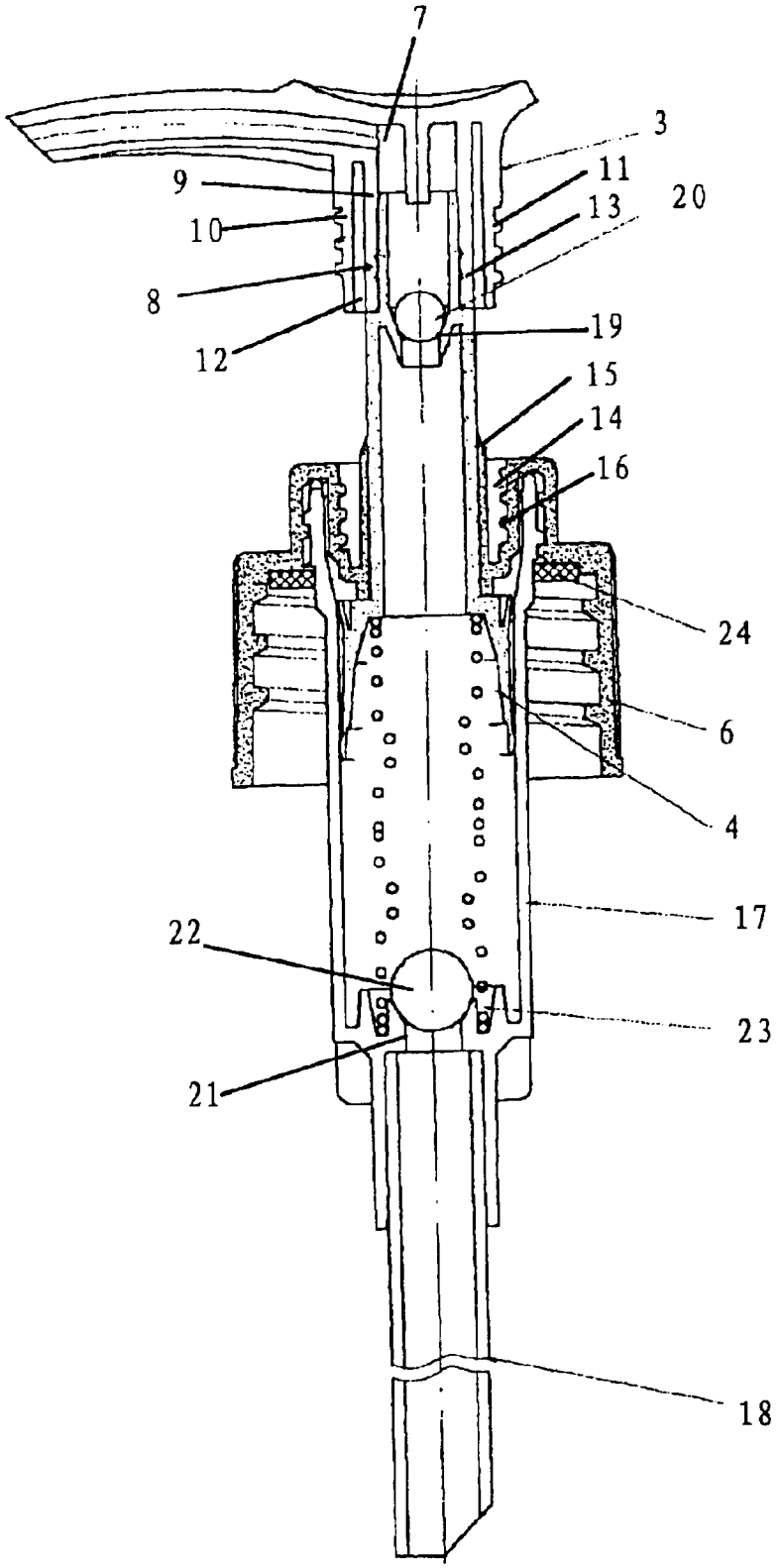
FIG. 4 is a schematic view of the structure of the emulsion pump of the present invention in an open state.

Referring to FIGS. 2 and 4, the emulsion pump according to the present invention comprises a pressing head 3, a piston rod 4, a screw-topped sleeve 6, a cylinder 17 and a rubber pipe 18.

There is a channel 7 in the pressing head 3 and a pipe connection 8 is on the lower end of the channel. The pipe connection 8 includes an inner pipe 9 and an outer pipe 10. The outer screw thread 11 is provided on the outer wall of the outer pipe 10 and a ring shaped concave groove 12 is provided between the inner pipe and the outer pipe.

The upper end 13 of the piston rod has a reduced outer diameter and is fixedly connected to the inner wall of the inner tube 9. The outer diameter of the remaining portion of the piston rod 4 is the same as the outer diameter of the inner pipe 9. An upper valve seat 19 is provided on the inner side of the piston rod 4. On the upper valve seat 19 is provided a glass ball 20, which together with the upper valve seat 19 forms a one-way valve which can be opened upwards.

The screw-topped sleeve 6 has a central through hole 14, a guide sleeve 15 for preventing liquid entrance is integrally formed with the lower portion of the central through hole 14. The inner wall of the guide sleeve preventing liquid entrance 15 can slidably match with the outer wall of the piston rod 4, and the upper end of the guide sleeve preventing liquid entrance 15 is higher than the upper plane of the screw-topped sleeve 6. In addition, an inner screw thread 16 which can engage with the outer screw thread 11 of the pressing head 3 is formed on the upper portion of the central through hole 14.

The upper end of the cylinder 17 is connected with the screw-topped sleeve 6 via screw thread, while the inner wall of the cylinder 17 hermetically and slidably contacts the lower end outer side wall of the piston rod 4. A lower valve seat 21 is arranged on the lower end of the inner side of the cylinder 17 and a lower glass ball 22 is disposed on the lower valve seat 21, the lower valve seat 21 and the lower glass ball 22 form a one-way valve which can be opened upwards. In addition, a spring 23 is disposed on the inner side of the cylinder 17. The upper end of the spring 23 abuts against the lower end of the piston rod 4, and the lower end of the spring 23 abuts against the lower end of the cylinder 17.

In addition, a gasket 24 is disposed on the inner side plane of the screw-topped sleeve 6, and a rubber pipe 18 is disposed on the lower end of the cylinder 17.

Figure 3:
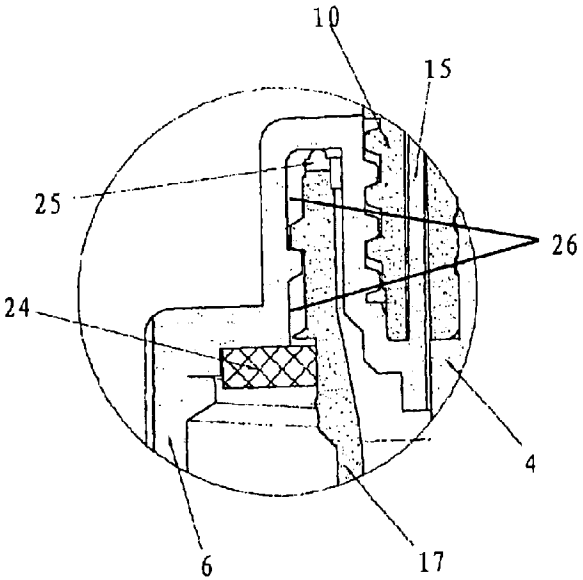
FIG. 3 is an enlarged view of circled portion A in FIG. 2.
Figure 5:
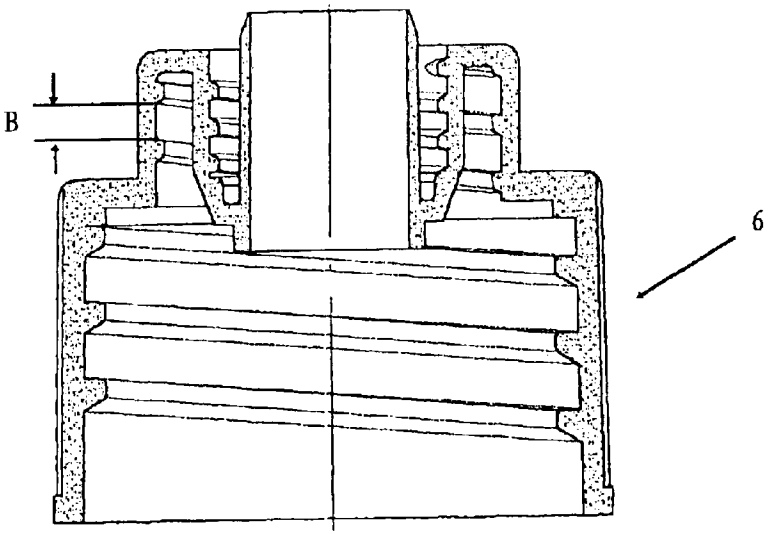
FIG. 5 is a longitudinal cross-sectional view of the screw-topped sleeve.
Figure 6:
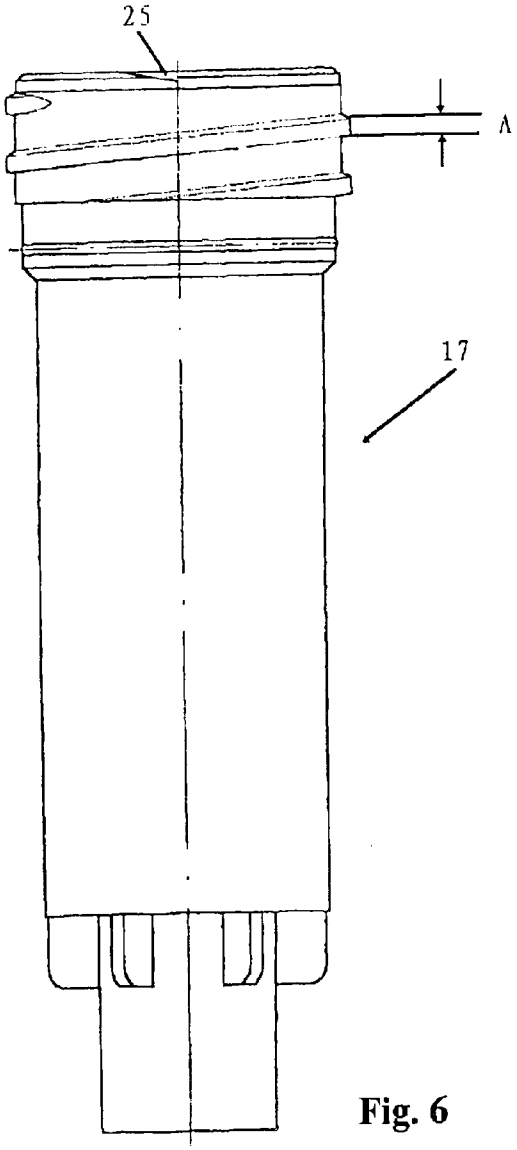
FIG. 6 is a side view of the cylinder.

As mentioned above, the upper end of the cylinder 17 is connected with the screw-topped sleeve 6 via screw thread. Referring to FIG. 3, FIG. 5 and FIG. 6. The width of the teeth of the upper end screw thread of the cylinder 17 is A; in addition, there is at least a notch 25 on the upper end of the cylinder 17. In addition, the width of the gullet of the screw thread portion of the screw-topped sleeve 6 which connects with screw thread of the cylinder 17 is B and the width of the gullet B is greater than the width A of the teeth. In this manner, when the upper screw thread of the cylinder 17 engages with the screw thread of the screw-topped sleeve 6, a gap 26 is formed between their screw threads (FIG. 3). Thereby an air channel is formed. Before the air channel reaches the bottle (not shown), the air channel must pass through several gaps and a notch, i.e., the gap between guide sleeve 15 for preventing liquid entrance of screw-topped sleeve and the piston rod 4, the notch 25 on the upper end of the cylinder 17, the gap between the cylinder 17 and the teeth of the screw-topped sleeve 6, the gap between the gasket 24 and the outer side wall of the cylinder 17. The air channel thus formed can effectively prevent emulsion in the bottle to pass through the air channel in reverse direction, thereby the liquid creeping-up phenomenon can be prevented.

Within the spirit and the scope of the present invention, there are still many modifications and variations which can be made to the embodiment of the present invention. For example, the notch 25 can be arranged on the top portion lower surface where the screw-topped sleeve 6 contacts the upper end of the cylinder 17, instead of arranging the notch on the upper end of the cylinder 17 (not shown). In thus way the above mentioned air channel can also be formed.

What is claimed is:

1. An emulsion pump having an air channel preventing liquid entrance, comprising:

a piston rod having an upper one-way valve;

a pressing head being fixed on the upper end of the piston rod;

a screw-topped sleeve having a central through hole and a screw thread portion;

a guide sleeve, wherein the guide sleeve is integrally formed on a lower wall of the central through hole, an inner wall of the guide sleeve preventing the liquid entrance slidably matches with an outer wall of the piston rod;

a cylinder having an upper screw thread which is connected to the screw thread portion of the screw-topped sleeve, wherein a lower one-way valve and a spring are provided in the cylinder;

a rubber pipe having an upper end which is fixedly connected with a lower end of the cylinder;

a gasket, which is arranged on an upper end of an outer side of the cylinder and abuts tightly against a lower surface of an inner side of the screw-topped sleeve;

wherein a width of teeth of the upper screw thread of the cylinder is A, a width of a gullet of the screw thread portion of the screw-topped sleeve which is connected with the upper screw thread of the cylinder is B, and B is greater than A, and gaps therebetween forming a portion of the air channel of the emulsion pump, and a gap is disposed between contact surfaces of the upper end of the cylinder and a top lower surface of the screw-topped sleeve.

2. The emulsion pump of claim 1, wherein at least one notch is disposed on the upper end of the cylinder.

* * * * *